US006775508B2

(12) United States Patent
Macht et al.

(10) Patent No.: US 6,775,508 B2
(45) Date of Patent: Aug. 10, 2004

(54) RETROFIT CLEANING ROLLER ASSEMBLY

(75) Inventors: Paul A. Macht, Savage, MN (US); Theodore L. Johnson, St. Louis Park, MN (US); Sheldon S. Puska, Coon Rapids, MN (US)

(73) Assignee: N.A. Trading and Technology, Bloomington, MN (US)

( * ) Notice: Subject to any disclaimer, the term of this patent is extended or adjusted under 35 U.S.C. 154(b) by 0 days.

(21) Appl. No.: 10/159,297

(22) Filed: May 29, 2002

(65) Prior Publication Data

US 2003/0016973 A1 Jan. 23, 2003

Related U.S. Application Data

(60) Provisional application No. 60/294,197, filed on May 29, 2001.

(51) Int. Cl.[7] ..... G03G 15/20; G03G 15/00

(52) U.S. Cl. ..... 399/327; 399/109

(58) Field of Search ..... 399/109, 122, 399/324, 325, 326, 327, 328; 15/256.51

(56) References Cited

U.S. PATENT DOCUMENTS

| | | | | |
|---|---|---|---|---|
| 3,672,764 A | | 6/1972 | Hartwig et al. | |
| 3,796,183 A | | 3/1974 | Thettu | |
| 3,980,424 A | | 9/1976 | Latone | |
| 4,278,345 A | | 7/1981 | Davis et al. | |
| 4,407,219 A | | 10/1983 | Dellevoet | |
| 4,757,347 A | * | 7/1988 | Tamaoki et al. | 399/325 |
| 5,142,122 A | | 8/1992 | Ariyama | |
| 5,191,380 A | | 3/1993 | Hoover et al. | |
| 5,272,509 A | | 12/1993 | Pitts et al. | |
| 5,543,903 A | * | 8/1996 | Fujita et al. | 399/327 |
| 5,678,152 A | * | 10/1997 | Kohno et al. | 399/324 |
| 5,690,739 A | | 11/1997 | Sassa et al. | |
| 5,709,748 A | | 1/1998 | Sassa et al. | |
| 6,041,211 A | * | 3/2000 | Hobson et al. | 399/327 X |
| 6,078,779 A | | 6/2000 | Hachisuga et al. | |
| 6,243,558 B1 | * | 6/2001 | Oota | 399/327 X |
| 6,477,350 B1 | * | 11/2002 | Nishimura | 399/327 X |

FOREIGN PATENT DOCUMENTS

WO WO 98/36331 8/1998

OTHER PUBLICATIONS

International Search Report (PCT/US02/17301) dated Jun. 20, 2003.

* cited by examiner

*Primary Examiner*—Sandra L. Brase
(74) *Attorney, Agent, or Firm*—Patterson, Thuente, Skaar & Christensen, P.A.

(57) ABSTRACT

A roller cleaning apparatus for retrofit installation in a photocopier fuser assembly having a housing and a fuser roller mounted in the housing. The apparatus may comprise a mounting strip adapted to engage a surface within the housing, a pair of resilient brackets spaced apart on the mounting strip, and a cleaning roller. Each of the resilient brackets has a bearing portion, and the cleaning roller is disposed between the pair of resilient brackets. The cleaning roller has a pair of opposing ends, each rotationally mounted in one of the bearing portions. The resilient brackets are configured so as to bias the cleaning roller against the fuser roller when the mounting strip is engaged with the housing. Also, a method for installing a roller cleaning apparatus in a photocopier fuser assembly.

20 Claims, 5 Drawing Sheets

RETROFIT CLEANING ROLLER ASSEMBLY

This application claims the benefit under 35 U.S.C 119(e) of U.S. Provisional Application No. 60/294,197 filed on May 29, 2001.

FIELD OF THE INVENTION

The present invention relates to an apparatus for cleaning copier rollers, and in particular, a retrofit assembly designed for cleaning the fuser and pressure rollers within certain copiers that did not include cleaning rollers at the time of manufacture.

BACKGROUND OF THE INVENTION

Toner-based photocopier machines, a typical example of which is shown in FIG. 1, contain a plurality of rollers to apply and fix toner dust to the surface of paper. In order to reproduce an original document image onto a second reproduction document, toner is transferred electrostatically and fused onto the second document within a fuser apparatus. This fusion process and the corresponding drawbacks are the central focus of the cleaning apparatus of the present invention.

Toner is baked or fused onto a second reproduction document in a series of steps. First, the reproduction document is fed generally in between two rollers which apply an oppositional force upon the paper. These two rollers consist of a pressure roller and a fuser roller. The pressure roller serves to feed the paper through the toner apparatus while continuously applying pressure upon the paper which keeps a portion of the paper in firm contact with the fuser roller during the feeding and fusion process. Second, the fuser roller contains an internal fuser lamp which provides a specific level of heat to the outer surface of the fuser roller. This fuser roller surface heat in turn is applied to the toner dust on the surface of the paper as the paper is brought into direct contact with the fuser roller. As the reproduction document is fed through the fuser apparatus, the once loose toner dust is fused onto the surface of the reproduction document.

This fusion process invariably causes excess toner dust to be left behind on the surface of both the pressure and fuser rollers. This residual toner dust diminishes the life of the fuser apparatus and affects the integrity of the reproductions. A build-up of excess toner dust on the rollers is particularly problematic in that it will tend to create a surface that further attracts and causes more dust build-up with each use of the fuser apparatus. This cyclical build-up problem reduces the useful life of the fuser apparatus, decreases the quality of the reproductions, and poses harm to any adjacent mechanical or electrical components.

Attempts have been made to address some of the mentioned problems. One common approach seeks to prevent initial build-up by modification of the roller surfaces themselves. Another approach focuses on the addition of one or more cleaning rollers to the fuser apparatus.

Modifications to the surface of both the fuser and pressure rollers are designed to minimize initial toner build-up. Generally, a thin layer of material such as polytetrafloroethene (PTFE) is bonded or coated to the outer cylindrical surface of the fuser or pressure rollers. While a PTFE coated surface is partially effective in reducing the adhesion of toner dust on the surface of the rollers, such a coating fails to completely eliminate the build-up of toner dust.

U.S. Pat. Nos. 5,142,122 and 6,078,779 are examples of disclosures that, at least in part, implement additional cleaning rollers that serve to remove impurities, such as excess toner dust, from the surface of the fuser roller. A cleaning roller is placed in contact with the surface of the fuser roller. The cleaning roller is generally made of felt or other fibrous materials. As the cleaning roller and fuser roller come into rotational contact with one another, the fibrous surface of the cleaning roller removes impurities such as toner dust from the surface of the fuser roller.

The art related to such cleaning rollers is limited, however, in that it discloses only cleaning roller apparatuses that are introduced into the fuser apparatus at the time of manufacture. These cleaning rollers are component structures within the manufactured fuser apparatus and are not capable of post-manufacture retrofit installation. Many photocopiers, however, utilize fuser apparatus that do not include such a cleaning roller at the time of manufacture. As a result, many copier users are unable to take advantage of the benefits such a cleaning roller system provides with regard to reproduction quality and fuser apparatus replacement costs. Consequently, there exists a substantial need for some type of retrofit cleaning roller apparatus that can be easily installed or dropped into an existing photocopier that does not have such an assembly already installed.

SUMMARY OF THE INVENTION

The preferred embodiment of the present invention provides a retrofit assembly enabling the installation or insertion of a cleaning roller assembly in those fuser apparatus which lack a cleaning roller assembly at the time of manufacture. This retrofitting is made possible by utilizing the existing structure and space available within the housing of presently manufactured fuser apparatus. By permitting the installation of cleaning roller assemblies, many advantages are realized.

Accordingly, the present invention may be characterized as a roller cleaning apparatus for retrofit installation in a photocopier fuser assembly having a housing and a fuser roller mounted in the housing. The apparatus may comprise a mounting strip adapted to engage a surface within the housing, a pair of resilient brackets spaced apart on the mounting strip, and a cleaning roller. Each of the resilient brackets has a bearing portion, and the cleaning roller disposed between the pair of resilient brackets. The cleaning roller has a pair of opposing ends, each rotationally mounted in one of the bearing portions. The resilient brackets are configured so as to bias the cleaning roller against the fuser roller when the mounting strip is engaged with the housing.

One object of the preferred embodiment is to permit the cleaning of fuser rollers so that the life span of fuser apparatus is greatly extended. This life span extension results in cost benefits since frequent replacement costs are significantly reduced. In addition, maintenance costs associated with frequent manual cleaning of the rollers are reduced since the installation of cleaning rollers greatly reduces the need for manual maintenance cleanings.

Another object of the preferred embodiment is to substantially increase the quality of reproductions produced by the copier as a direct result of the removal of impurities from the surface of the fuser and pressure rollers.

Yet another object of the preferred embodiment is to lengthen the life span of adjacent mechanical or electrical components by minimizing their exposure to impurities such as toner dust.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Figure 1:
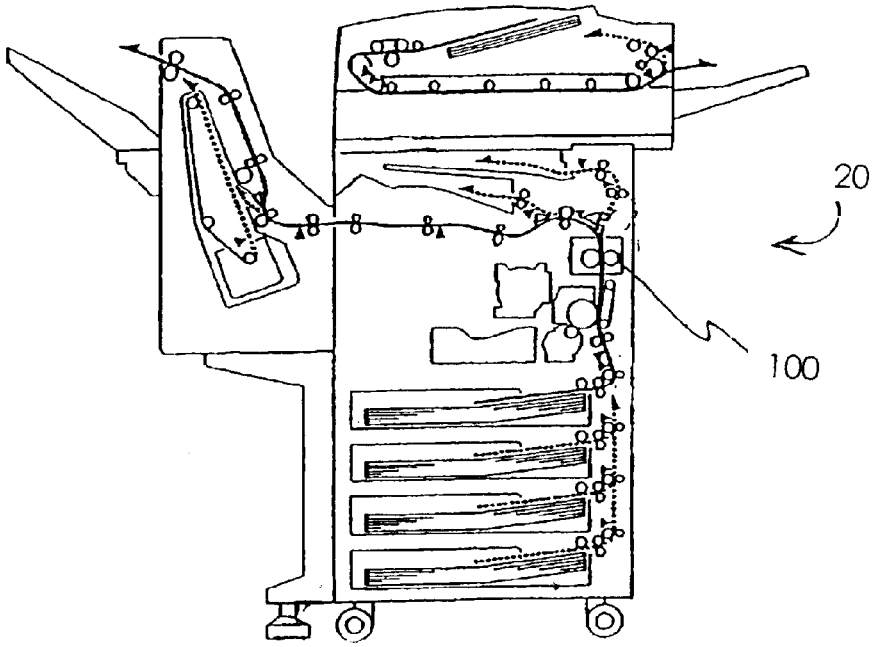
FIG. 1 shows a simplified cross section of a typical photocopier and the location of a fuser assembly therein.

Looking to the preferred embodiment of FIGS. 2 through 8, a cleaning roller assembly 200 consists of a cleaning roller 206 and a roller holder 205, which comprises a mounting strip 204, and resilient brackets 202. This assembly 200 is inserted into a manufactured fuser apparatus 100 of a copier 20 which at the time of manufacturing and installation lacks a cleaning roller assembly designed to remove impurities such as toner dust from the surface of the fuser roller 104. Ricoh® copiers, models 340, 350, 355, 450, and 455, are examples of copiers that would benefit from the installation of cleaning roller assembly 200. Removal of impurities from the surface of a fuser roller 104 extends the useful life of the fuser apparatus 100, thus greatly reducing associated replacement costs. In addition, a properly cleaned fuser apparatus 100 results in improved document reproduction quality.

Figure 2:
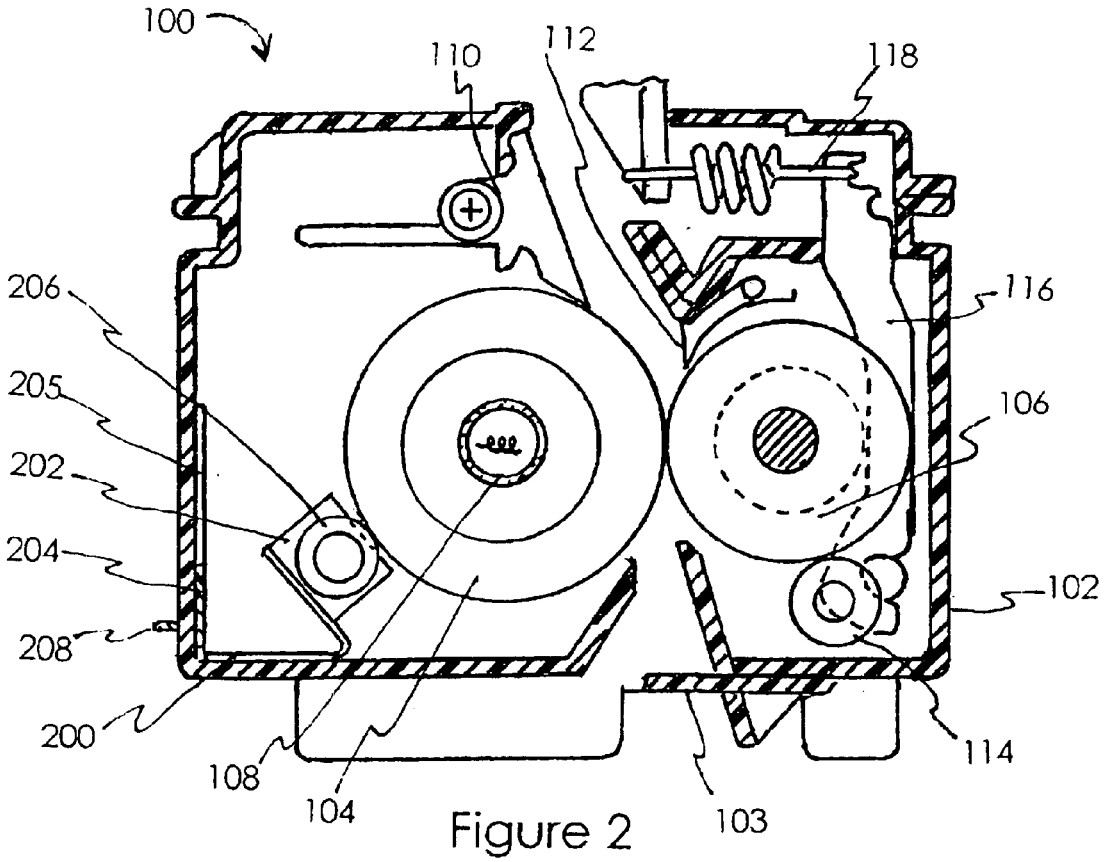
FIG. 2 shows a simplified cross-sectional view of a fuser assembly.

Fuser apparatus 100, as shown in FIG. 2, typically consists of a fuser roller 104, a pressure roller 106, a housing 102, and a cover 103. Fuser roller 104 and pressure roller 106 are placed within housing 103 so that the cylindrical rollers 104, 106 rest longitudinally parallel to each other. Pressure roller 106 is held against fuser roller 104 by arm 116, biased by spring 118. The rollers 104, 106 initiate rotational movement that provides the feeding motion necessary to pull paper into direct contact with, and in between both rollers 104, 106. Lamp 108 provides heat to fuser roller 104. As the paper is fed through rollers 104, 106, toner dust that has been applied to the paper in a pattern corresponding to the image to be duplicated, is fused onto the paper by way of heated fuser roller 104. Strippers 110 and 112 prevent the paper from wrapping around fuser roller 104 or pressure roller 106 respectively. In many copier models, metal cleaning roller 114, placed in contact with pressure roller 106, is provided to remove some of the toner dust that may be undesirably adhered to the roller.

Figure 3:
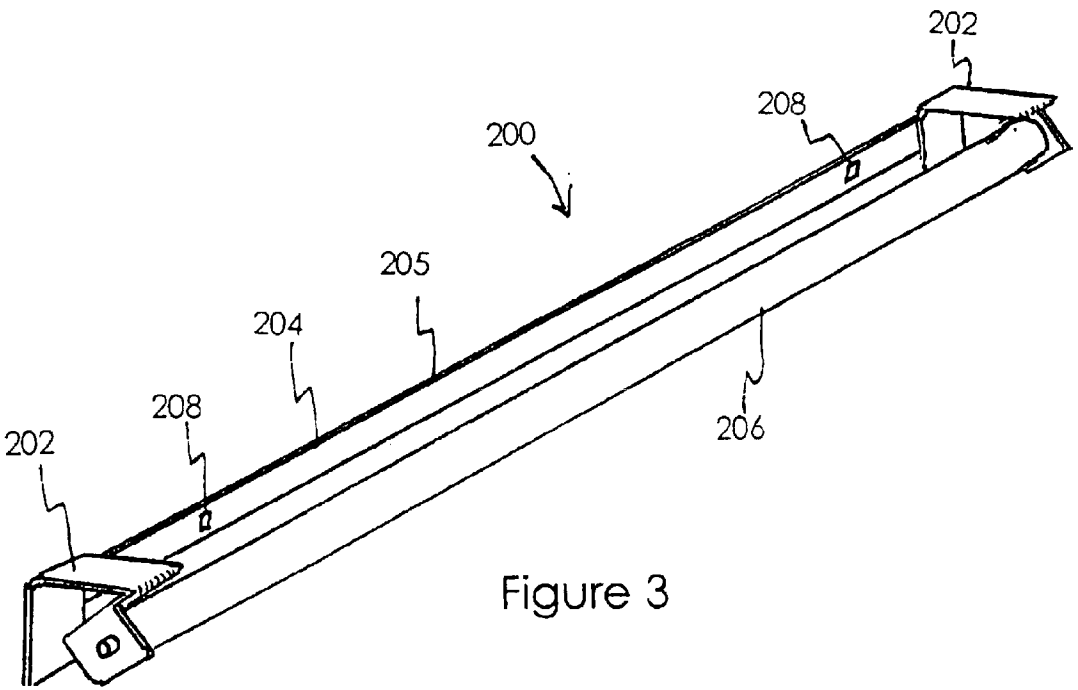
FIG. 3 shows a perspective view of a preferred embodiment of a cleaning roller assembly according to the present invention.
Figure 5:
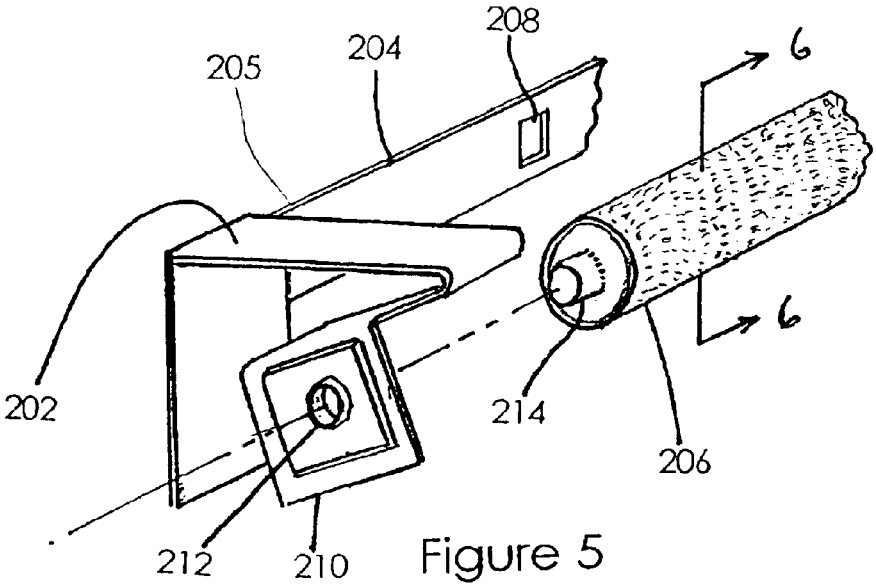
FIG. 5 shows a perspective view of a portion of a cleaning roller assembly.
Figure 6:
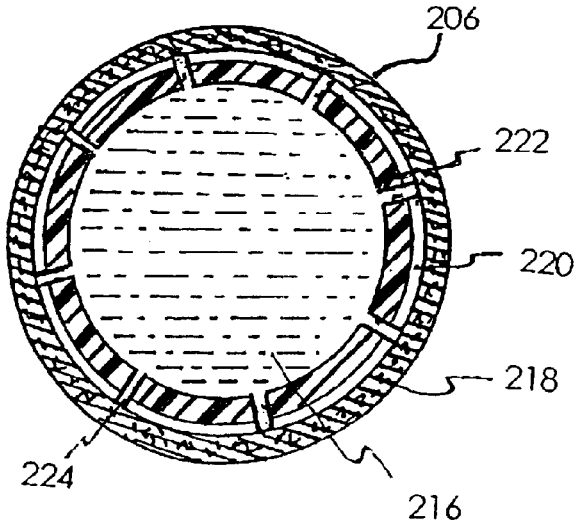
FIG. 6 shows a cross-sectional view of a cleaning roller according to the present invention.

The cleaning roller assembly 200 of the present invention is constructed in a manner making it easy to drop into fuser apparatus 100. The construction of cleaning roller 206, as shown in detail in FIGS. 3, 5 and 6, is a conventional cylindrical cleaning roller consisting of an inner shaft 222 and an outer covering 218, with outer covering 218 typically made of a fibrous material, such as aramid felt or aramid paper. Inner shaft 222 is generally hollow and impregnated with an oil or silicon 216. In between outer covering 218 and inner shaft 222 is a layer of flexible insulation 220. Flexible insulation 220 may be a spun-bonded polyolefin sheet material, such as Tyvec®. A plurality of bores 224 provide a plurality of channels between inner shaft 222, traversing through insulation 220, and opening up some distance into outer covering 218 such that there are a plurality of channels for the oil or silicon 216 to traverse from inner shaft 222 and penetrate outer covering 218 material. The oil or silicon 216 facilitates the attraction of impurities to cleaning roller 206 upon contact with fuser roller 104 or, as will be seen herein with an alternative embodiment, with pressure roller 106.

Cleaning roller 206 is removably attached to roller holder 205 so that it securely rests rotationally unrestricted in a position below and parallel to roller holder 205. Roller holder 205 comprises mounting strip 204 joining resilient brackets 202. Resilient brackets 202 may be constructed of any suitable memory resilient material, and are preferably constructed of a memory resilient metal. In a preferred embodiment, such as is shown in FIG. 5, resilient brackets 202 each may have a bearing portion insert 210 containing bearing portion 212. Bearing portion 212 is sized to receive a portion 214 of inner shaft 222 and allow free rotation of cleaning roller 206. Resilient brackets 202 are constructed such that pressure upon cleaning roller 206 will permit movement of cleaning roller 206 upward to a position closer to mounting strip 204, as long as the pressure is continuously applied. Upon cessation of the upwardly applied pressure, resilient brackets 202 will return cleaning roller 206 to its original position. As will be appreciated by those of skill in the art, the mounting strip 204 and resilient brackets 202 comprising roller holder 205 may be formed all in one piece if desired.

Figure 9:
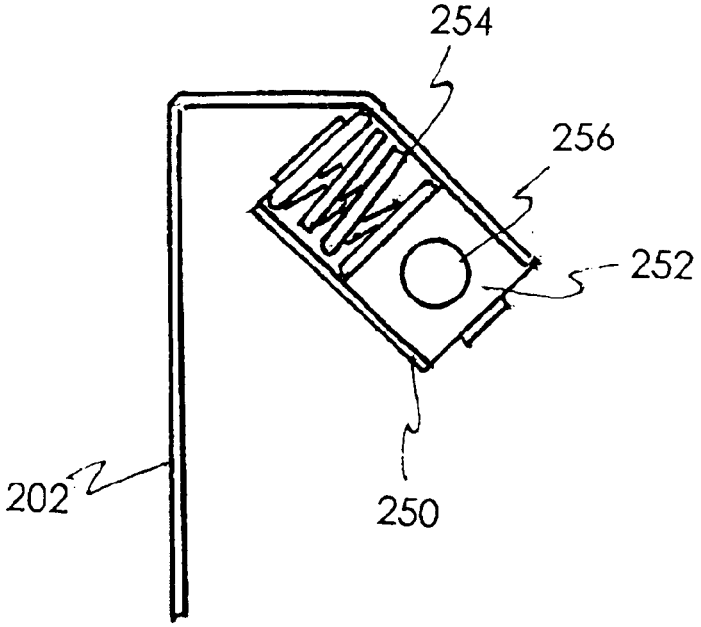
FIG. 9 shows an elevational view of an alternative embodiment of a resilient bracket.
Figure 10:
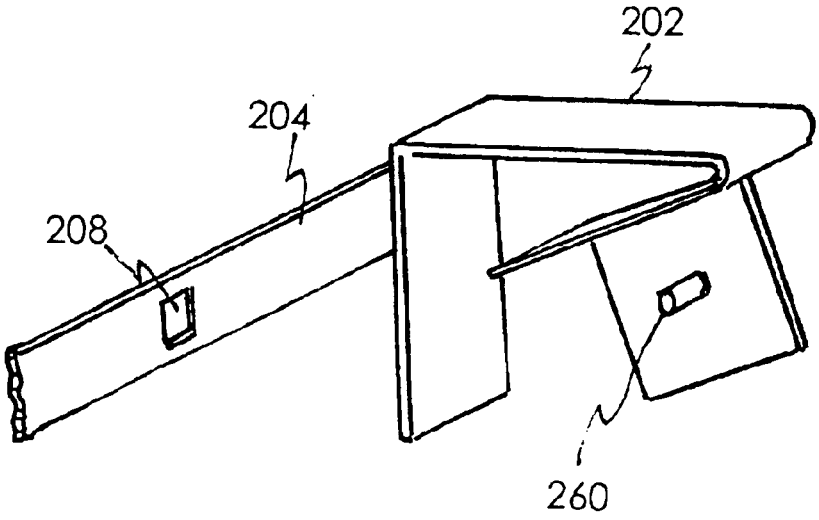
FIG. 10 shows a perspective view of another alternative embodiment of a resilient bracket.

Although the configuration of resilient brackets 202 as illustrated in FIG. 5 is currently most preferred, many alternative embodiments are possible within the scope of the present invention. For example, in FIG. 9 there is shown an alternative resilient bracket 202 in which bearing portion insert 252 and bearing portion 256 are slidably disposed in channel 250. The resilient quality of the bracket is provided by spring 254, which biases bearing portion insert 252 outward. In FIG. 10 there is shown an alternative embodiment of resilient bracket 202 having pin 260 in place of bearing portion 212. Cleaning roller 206 is rotationally mounted on pin 260 in this embodiment by means of bores (not shown) provided in the ends of cleaning roller 206, which are sized to receive pins 260.

Figure 7:
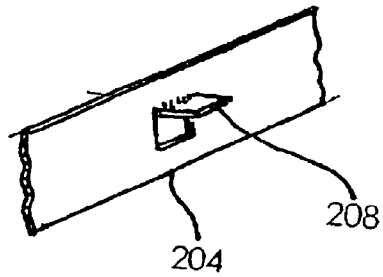
FIG. 7 shows a view of a locking tab.
Figure 8:
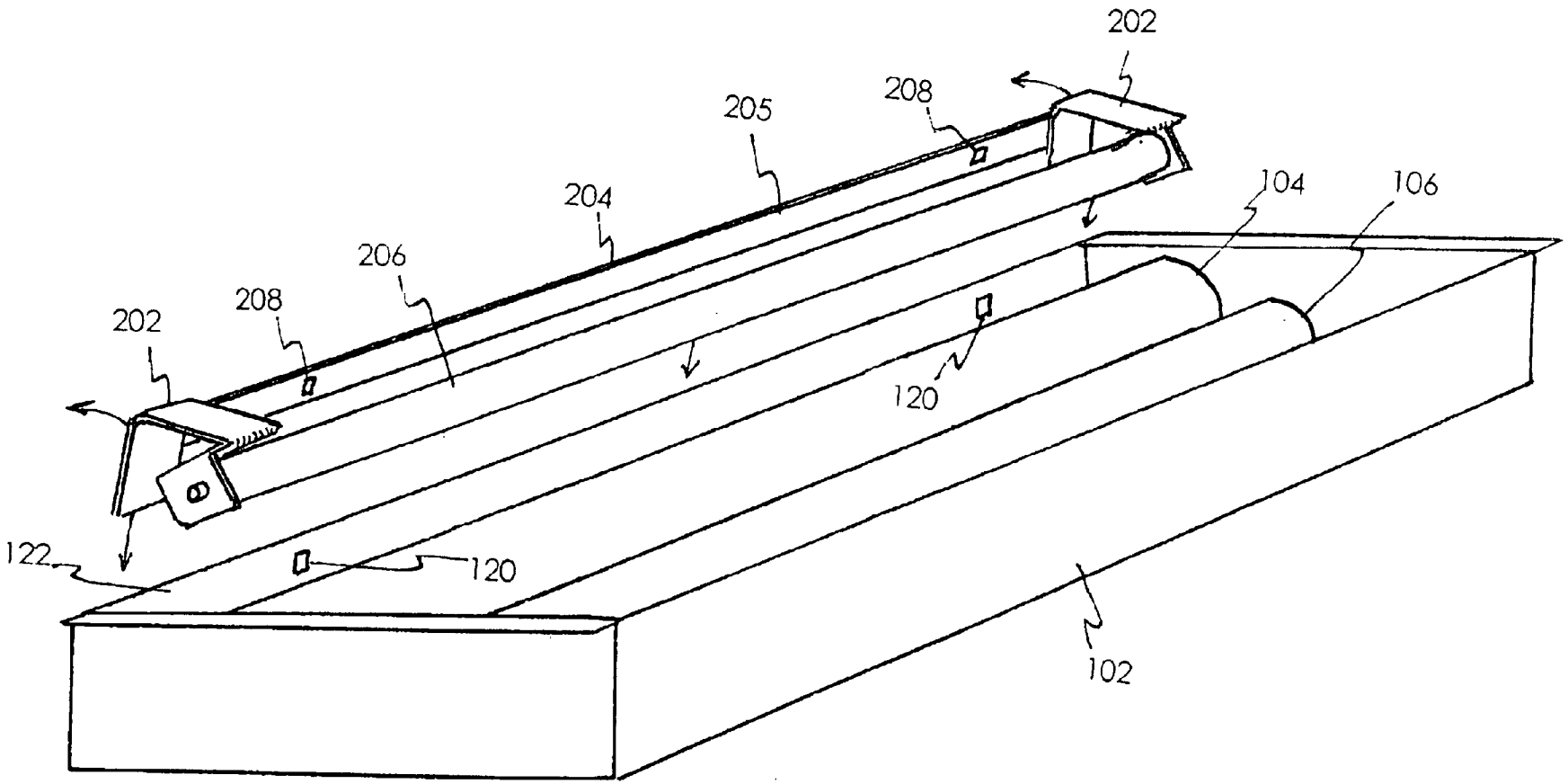
FIG. 8 shows a simplified view of a fuser assembly with a cleaning roller assembly in process of installation.

As shown in FIGS. 7 and 8, cleaning roller assembly 200 may attached to inner surface 122 of housing 102 by the interlocking of a plurality of tabs 208 to housing apertures 120. The plurality of tabs 208 extend out from mounting strip 204 and are aligned for locking connection through housing apertures 120 such that, upon attachment of cleaning roller assembly 200 to housing 102, cleaning roller 206 is attached and resting rotationally unrestricted some distance below mounting strip 204 so that outer covering 218 of cleaning roller 206 is in direct rotational contact with fuser roller 104 along substantially the entire longitudinal distance of fuser roller 104.

Upon assembly, cover 103 is placed over housing 102 as shown in FIG. 2, in a manner that covers rollers 104, 106 and applies pressure inwardly on cleaning roller assembly 200, causing compression of resilient brackets 202 and, consequently, ensuring surface contact between outer covering 218 of cleaning roller 206 and fuser roller 104.

The installation of cleaning roller assembly 200 in fuser assembly 100 begins with first removing cover 103 from housing 102. Cleaning roller assembly 200 may be dropped into position and tabs 208 engaged with housing apertures 120, and with roller holder 205 in contact with inner surface 122 of housing 102 as shown in FIG. 8. Cover 103 is then replaced, compressing resilient brackets 202 and forcing cleaning roller 206 into contact with fuser roller 104.

Figure 4:
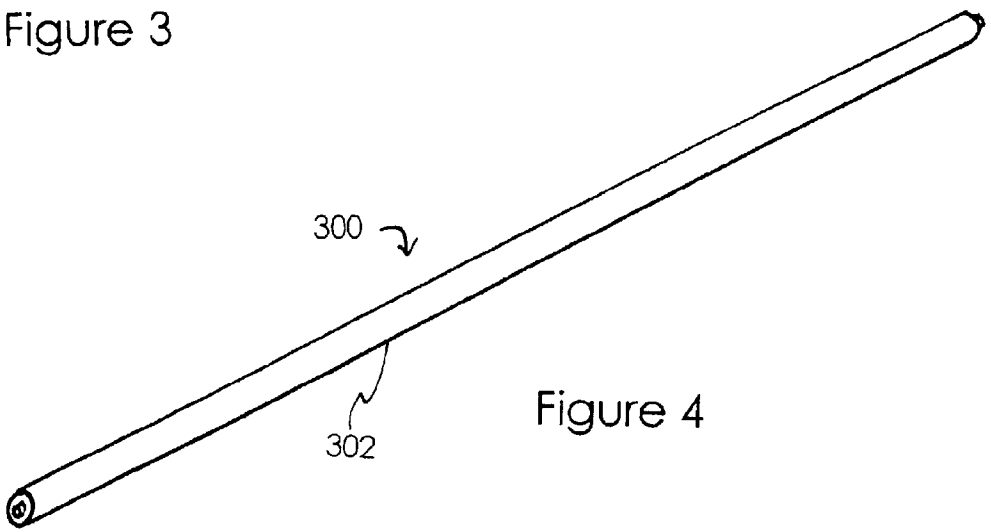
FIG. 4 shows a perspective view of an alternative embodiment of a cleaning roller assembly.

In an alternative embodiment 300, as seen in FIG. 4, a variation of cleaning roller assembly 200 is implemented. Fibrous roller 302, duplicating the construction of cleaning roller 206 as it is shown in the preferred embodiment of FIG. 6, assists in the cleaning of pressure roller 106. This alternative embodiment 300 can be installed in addition to, or in lieu of, preferred embodiment cleaning roller assembly 200. In many situations, a metal cleaning roller 114 already exists within a toner apparatus 100, as shown in FIG. 2. Metal cleaning roller 114 is generally attached within fuser apparatus 100 in a manner that causes metal cleaning roller 114 to securely rest rotationally unrestricted some distance from cover 103 so that the outer surface of metal cleaning roller 114 is in direct rotational contact with pressure roller 106. While this metal cleaning roller 114 provides some cleaning benefit, it is far less effective than a cleaning roller covered with impurity-grabbing fibrous materials such as aramid felt. Consequently, the alternative embodiment of cleaning roller assembly 300 replaces metal cleaning roller 114. As previously stated herein, fibrous roller 302 duplicates the construction of cleaning roller 206. Fibrous rollers 302 are manufactured in various lengths and sizes according to the metal cleaning rollers 114 they are designed to replace. The outer diameter of fibrous roller 302 is substantially the same as the outer diameter of the metal cleaning roller 114 it is designed to replace. At assembly, metal cleaning roller 114 is merely removed and replaced with fibrous roller 302.

Although the description above contains many specificities, these should not be construed as limiting the scope of the invention but as merely providing illustrations of some of the presently preferred embodiments of the invention. Thus, the scope of the invention should be determined by the appended claims and their legal equivalents, rather than by the examples given.

What is claimed is:

1. A roller cleaning apparatus for retrofit installation in a photocopier fuser assembly, said fuser assembly having a housing and a fuser roller mounted in the housing, the apparatus comprising:

a mounting strip adapted to engage a surface within said housing;

a pair of resilient brackets spaced apart on said mounting strip, each of said resilient brackets having a bearing portion; and a cleaning roller disposed between said pair of resilient brackets, said cleaning roller having a pair of opposing ends, each of said pair of opposing ends rotationally mounted in one of said bearing portions, said resilient brackets configured so as to bias said cleaning roller against said fuser roller when said mounting strip is engaged with said surface within said housing;

whereby said cleaning roller removes toner dust and other impurities from said fuser roller when said fuser assembly is in operation.

2. The roller cleaning apparatus of claim 1, wherein said cleaning roller comprises an inner shall portion enwrapped with a layer of spun-bonded polyolefin material and a layer of aramid material.

3. The roller cleaning apparatus of claim 2, wherein said inner shaft portion is impregnated with oil or silicone, wherein said aramid material forms an outermost layer of said cleaning roller and wherein said cleaning roller has a plurality of passages for allowing said oil or silicone to pass from said inner shaft portion to said outermost layer of aramid material.

4. The roller cleaning apparatus of claim 1, wherein said mounting strip has a plurality of tab structures, and wherein said tab structures are adapted to engage openings in said surface within said housing.

5. The roller cleaning apparatus of claim 1, wherein each of said resilient brackets is formed from memory metal.

6. The roller cleaning apparatus of claim 1, wherein each of said resilient brackets includes a spring member.

7. A method for retrofitting a photocopier fuser assembly with a roller cleaning apparatus, the method comprising:

providing a photocopier fuser assembly having a housing with a removable cover and a fuser roller mounted in the housing;

providing a roller cleaning apparatus having a cleaning roller and a roller holder having a mounting portion and a pair of resilient bracket portions spaced apart on said mounting portion, said mounting portion adapted to engage a surface within said housing, said cleaning roller rotatably mounted between said bracket portions, said resilient bracket portions configured so as to bias said cleaning roller against the fuser roller when said mounting portion is engaged with said surface within said housing;

removing said removable cover;

placing said roller cleaning apparatus into said housing with said cleaning roller in contact with said fuser roller;

engaging said mounting portion with said surface within said housing so as to bias said cleaning roller against said fuser roller; and replacing said removable cover.

8. The method of claim 7, wherein said photocopier fuser assembly further comprises a pressure roller mounted in said housing and engaged with said fuser roller and a metal cleaning roller engaged with said pressure roller, and wherein the method further comprises the steps of:

providing a replacement cleaning roller having substantially identical dimensions to the metal cleaning roller, said replacement cleaning roller comprising an inner shaft portion enwrapped with a layer of spun-bonded polyolefin material and a layer of aramid material;

removing said metal cleaning roller; and installing said replacement cleaning roller in place of said metal cleaning roller.

9. A method for retrofitting a photocopier fuser assembly with a roller cleaning apparatus comprising:

providing a photocopier fuser assembly having a housing, a fuser roller mounted in the housing, a pressure roller mounted in the housing and engaged with the fuser roller, and a metal cleaning roller mounted in the housing and engaged with the pressure roller;

providing a replacement cleaning roller having substantially identical dimensions to the metal cleaning roller, said replacement cleaning roller comprising an inner shaft portion enwrapped with a layer of spun-bonded polyolefin material and a layer of aramid material;

removing the metal cleaning roller; and installing the replacement cleaning roller in the place of the metal cleaning roller.

10. A roller cleaning apparatus for retrofit installation in a photocopier fuser assembly, said fuser assembly having a housing and a fuser roller mounted in the housing, the apparatus comprising:

a cleaning roller comprising an inner shaft portion impregnated with oil or silicone, wherein said cleaning roller inner shaft portion is enwrapped with a layer of spun-bonded polyolefin material and a layer of aramid material, said aramid material forming the outermost layer of said cleaning roller and said cleaning roller having a plurality of passages for allowing said oil or silicone to pass from said inner shaft portion to said outermost layer of aramid material;

means for mounting said cleaning roller within said housing; and means for biasing said cleaning roller in rotatable contact with said fuser roller;

whereby said cleaning roller removes toner dust and other impurities from said fuser roller when said fuser assembly is in operation.

11. The roller cleaning apparatus of claim 10, wherein said means for biasing said cleaning roller comprises a pair of resilient brackets, wherein said mounting means comprises a mounting strip adapted to engage a surface within said housing, said pair of resilient brackets being spaced apart on said mounting strip, and wherein said cleaning roller is rotatably mounted between said resilient brackets.

12. The roller cleaning apparatus of claim 11, wherein said resilient brackets are formed from memory metal.

13. The roller cleaning apparatus of claim 11, wherein each of said resilient brackets includes a spring member.

14. A roller cleaning apparatus for retrofit installation in a photocopier fuser assembly, said fuser assembly having a housing and at least one fuser roller, the apparatus comprising:

a cleaning roller; and a roller holder having a mounting portion and a pair of resilient bracket portions spaced apart on said mounting portion, said mounting portion adapted to engage a surface within said housing, said cleaning roller rotatably mounted between said bracket portions, said resilient bracket portions configured so as to bias said cleaning roller against the fuser roller when said mounting portion is engaged with said surface within said housing, whereby said cleaning roller removes toner dust and other impurities from said fuser roller when said fuser assembly is in operation in a photocopier.

15. The roller cleaning apparatus of claim 14, wherein said cleaning roller comprises an inner shaft portion enwrapped with a layer of spun-bonded polyolefin material and a layer of aramid material.

16. The roller cleaning apparatus of claim 15, wherein said inner shaft portion is impregnated with oil or silicone, wherein said aramid material forms an outermost layer of said cleaning roller and wherein said cleaning roller has a plurality of passages for allowing said oil or silicone to pass from said inner shaft portion to said outermost layer of aramid material.

17. The roller cleaning apparatus of claim 14, wherein said mounting portion has a plurality of tab structures, and wherein said tab structures are adapted to engage openings in said surface within said housing.

18. The roller cleaning apparatus of claim 14, wherein each of said resilient bracket portions is formed from memory metal.

19. The roller cleaning apparatus of claim 14, wherein each of said resilient brackets includes a spring member.

20. The roller cleaning apparatus of claim 14, wherein said cleaning roller has a pair of opposing ends, wherein each of said resilient brackets includes a bearing portion adapted to receive one of said pair of opposing ends, and wherein each bearing portion is rotatably engaged with a separate one of said pair of opposing ends.

* * * * *